US009365809B1

(12) United States Patent
Maiuri

(10) Patent No.: US 9,365,809 B1
(45) Date of Patent: Jun. 14, 2016

(54) CLEANING SOLUTION FOR SMOKING PARAPHERNALIA AND METHOD THEREFOR

(71) Applicant: 710-CLEANER, LLC, Scottsdale, AZ (US)

(72) Inventor: John Maiuri, Scottsdale, AZ (US)

(73) Assignee: 710-CLEANER, LLC, Scottsdale, AZ (US)

( * ) Notice: Subject to any disclaimer, the term of this patent is extended or adjusted under 35 U.S.C. 154(b) by 0 days.

(21) Appl. No.: 14/656,208

(22) Filed: Mar. 12, 2015

Related U.S. Application Data

(60) Provisional application No. 61/951,721, filed on Mar. 12, 2014.

(51) Int. Cl.
*C11D 7/26* (2006.01)
*C11D 7/10* (2006.01)
*C11D 7/44* (2006.01)

(52) U.S. Cl.
CPC *C11D 7/265* (2013.01); *C11D 7/10* (2013.01); *C11D 7/261* (2013.01); *C11D 7/263* (2013.01); *C11D 7/44* (2013.01)

(58) Field of Classification Search
CPC .... C11D 3/046; C11D 3/2017; C11D 3/2006; C11D 3/2068; C11D 3/2075; C11D 7/261; C11D 7/263
See application file for complete search history.

(56) References Cited

U.S. PATENT DOCUMENTS

| | | | | |
|---|---|---|---|---|
| 4,832,868 | A | 5/1989 | Schmid et al. | |
| 6,284,056 | B1 * | 9/2001 | Gonzalez | A24F 9/12 134/39 |
| 6,767,874 | B2 | 7/2004 | Gonzalez | |
| 7,056,874 | B2 | 6/2006 | Tadrowski et al. | |
| 7,696,145 | B2 | 4/2010 | Kaaret | |
| 8,444,768 | B2 | 5/2013 | Quillen et al. | |
| 2005/0119143 | A1 | 6/2005 | Egbe et al. | |
| 2008/0255023 | A1 | 10/2008 | Shimmin et al. | |
| 2009/0288683 | A1 | 11/2009 | Cummings et al. | |
| 2012/0046212 | A1 | 2/2012 | Bourdette et al. | |
| 2012/0142577 | A1 | 6/2012 | Sun et al. | |

* cited by examiner

*Primary Examiner* — Brian P Mruk
(74) *Attorney, Agent, or Firm* — Weiss & Moy, P.C.; Veronica-Adele R. Cao; Jeffrey D. Moy

(57) ABSTRACT

A cleaning solution for smoking paraphernalia and other cleaning surfaces which may comprise: carboxylic acid, dipropylene glycol monomethyl ether, iodized salt, isopropyl alcohol, 2-butoxyethanol, ethylene glycol n-hexyl ether, and water. The solution may also contain grain alcohol and raw lemon. The solution may be combined with water and then heated prior to being applied to the soiled surface for cleaning.

11 Claims, No Drawings

CLEANING SOLUTION FOR SMOKING PARAPHERNALIA AND METHOD THEREFOR

CROSS-REFERENCE TO RELATED APPLICATION

This non-provisional application claims priority to U.S. Provisional Application No. 61/951,721 filed on Mar. 12, 2014 in the name of the Applicant herein.

TECHNICAL FIELD

This disclosure generally relates to cleaning solutions and, more particularly to, a cleaning solution that may be used for multiple purposes which include, but are not limited to, dissolving residue that may build up on the surface of smoking paraphernalia.

BACKGROUND OF THE INVENTION

*Cannabis*, used for medicinal purposes, and tobacco may be smoked by using pipes or bongs. Pipes, also called "bowls," may be made of blown glass, ceramic, metal, plastic, and other suitable materials. A pipe typically has a receptacle (with a screen), a stem, and a mouthpiece. The leaves of the *cannabis* or tobacco are placed in the receptacle and burned. When the user inhales through the mouthpiece, smoke travels from the burning leaves through the bowl, stein, mouthpiece, and finally into the mouth of the user. A bong or "water pipe" is similar to a pipe, but it also has a water chamber. Smoke from the burning leaves travels through the water chamber prior to inhalation. A user typically fills the bong with water, which is used to cool the smoke. A user may then place the *cannabis* or tobacco leaves in the bowl, and place the bowl in the bong so that the distal end is immersed in water. The user will then place their mouth over the mouthpiece and burn the *cannabis* or tobacco leaves causing smoke to build up within the chamber. The user then stops burning the leaves, remove the bong, and inhale the smoke within the chamber.

Over time, a dark black and sticky organic residue may form on the inside of the pipe or bowl. The residue may contain plant matter from the tobacco, *cannabis*, or herbs that may have been burned and smoked with the pipe. The residue is so thick that ordinary dish soap or glass cleaner is not sufficient to clean the pipe or bowl. Furthermore, the pipes and bongs are small and are usually very difficult to scrub clean. Therefore a need exists for an effective cleaning solution that may be used for many purposes, which includes cleaning residue that may build up on the surface of smoking paraphernalia. Although the cleaning solution is described as cleaning the residue from smoking paraphernalia in the examples herein, it should be clearly understood that the cleaning solution of the present invention may be used to clean any soiled surface including, but not limited to: concrete, carpet, jewelry, metals, plastic, low-thermal-expansion borosilicate glass, pots and pans, ceramic, pipes, sinks, drains, etc.

SUMMARY OF THE INVENTION

This summary is provided to introduce a selection of concepts in a simplified form that are further described below in the DESCRIPTION OF THE APPLICATION. This summary is not intended to identify key features of the claimed subject matter, nor is it intended to be used as an aid in determining the scope of the claimed subject matter.

In accordance with one embodiment of the present invention, a cleaning solution is disclosed. The cleaning solution comprises: carboxylic acid; dipropylene glycol monomethyl ether; iodized salt; 91% isopropyl alcohol; 2-butoxyethanol; ethylene glycol n-hexyl ether; 100% isopropanol; water; and grain alcohol.

In accordance with another embodiment of the present invention, a cleaning solution is disclosed. The cleaning solution comprises: between 12.50% by weight and 13.44% by weight of carboxylic acid; between 28.13% by weight and 30.31% by weight of dipropylene glycol monomethyl ether; 3.12% by weight of iodized salt; between 28.13% by weight and 31.25% by weight of 91% isopropyl alcohol; 6.25% by weight of 2-butoxyethanol; 1.88% by weight of ethylene glycol n-hexyl ether; 1.25% by weight of 100% isopropanol; 3.12% by weight of water; and 6.25% by weight of 190 proof grain alcohol.

In accordance with another embodiment of the present invention, a method for cleaning a soiled surface is disclosed. The method comprises the steps of: mixing a cleaning solution comprising: between 0.48% by weight and 27.88% by weight of carboxylic acid; between 1.08% by weight and 62.71% by weight of dipropylene glycol monomethyl ether; between 3.12% by weight and 6.25% by weight of iodized salt; between 1.56% by weight and 42.19% by weight of 91% isopropyl alcohol; between 1.56% by weight and 12.50% by weight of 2-butoxyethanol; between 0.50% by weight and 3.75% by weight of ethylene glycol n-hexyl ether; between 0.31% by weight and 2.50% by weight of 100% isopropanol; between 0.81% by weight and 6.25% by weight of water; and between 1.56% by weight and 12.50% by weight of grain alcohol; diluting the cleaning solution by adding 1 oz of water to every 16 oz of cleaning solution; heating the diluted cleaning solution; and applying the diluted cleaning solution and water to the soiled surface for cleaning.

DESCRIPTION OF THE DISCLOSURE

The description set forth below is intended as a description of presently preferred embodiments of the disclosure and is not intended to represent the only forms in which the present disclosure can be constructed and/or utilized. The description sets forth the functions and the sequence of steps for constructing and operating the disclosure. It is to be understood, however, that the same or equivalent functions and sequences can be accomplished by different embodiments that are also intended to be encompassed within the spirit and scope of this disclosure.

The cleaning solution of the present invention may be used to conveniently and thoroughly clean smoking paraphernalia that are used to smoke *cannabis* or tobacco. The smoking paraphernalia may be made of glass, ceramic, plastic, metal or some other suitable material.

The cleaning solution may comprise the following ingredients: carboxylic acid, dipropylene glycol monomethyl ether, iodized salt, isopropyl alcohol, citrus juice, 2-butoxyethanol, ethylene glycol n-hexyl ether, and water. Optionally, the solution may also contain grain alcohol. These components may be added to the solution individually. Alternatively, some of the components may be pre-combined prior to being added to the solution. For example dipropylene glycol monomethyl ether and carboxylic acid may be added to the solution in a combination that is commercially available (e.g. BLAST-OFF FOAM CONCENTRATE, which is sold by Nox-Crete Manufacturing Inc.).

Carboxylic acid is an organic acid characterized by having at least one carboxyl group. Carboxylic acids are known to have higher boiling points than water. Dipropylene glycol monomethyl ether is a colorless liquid that is completely soluble in water. Dipropylene glycol monomethyl ether may be used as a solvent and is often formulated into cleaners, such as household and industrial cleaners, grease and paint removers, metal cleaners, and hard surface cleaners.

Isopropyl alcohol (rubbing alcohol) is an alcohol based solvent that can dissolve a wide range of non-polar compounds and therefore is often used as a cleaning fluid. Isopropyl alcohol may be used to dissolve many oils, gums, and natural resins. In the present invention, the cleaning solution may contain isopropyl alcohol that has been initially diluted with water to form 91% isopropyl alcohol. 91% isopropyl alcohol typically comprises 91% isopropanol and 9% water. The cleaning solution may be prepared with 91% isopropanol that has been initially diluted with water prior to preparation of the cleaning solution, and then adding 100% isopropanol and water separately during preparation of the cleaning solution, wherein the added 100% isopropanol is not initially diluted with the water. Alternatively, the cleaning solution may be prepared by adding 100% isopropanol and water separately, wherein the 100% isopropanol is not initially diluted with the water. It should also be clearly understood that substantial benefit may also be derived from alternative concentrations of isopropyl alcohol, for example 70-91% isopropyl alcohol may be used.

Grain alcohol may also be used in the present invention. Commercially available sources of grain alcohol may be used (e.g. EVERCLEAR, which is made by Luxco, Inc.). In one embodiment, wherein grain alcohol is present in the cleaning solution, 91% isopropyl alcohol may be used. Alternatively, if grain alcohol is not present in the cleaning solution, then only 100% isopropyl alcohol may be used, without any previously diluted 91% isopropyl alcohol, in order to get the same efficacy as using the combination of 91% isopropyl alcohol with grain alcohol. While 190 proof grain alcohol is used in the examples, it should also be clearly understood that an alternative proof of grain alcohol may be used. For example, any grain alcohol between 100-190 proof may be used.

2-butoxyethanol may also be used in the cleaning solution of the present invention. Commercially available sources of 2-butoxyethanol may be used (e.g. LA'S TOTALLY AWESOME ORANGE all-purpose degreaser, made by Awesome Products, Inc.). 2-butoxyethanol is an organic solvent that is used in paints, cleaning products, degreasers and liquid soaps. It should also be clearly understood that substantial benefit may also be obtained from the use of ethylene glycol, 2-methoxyethanol, or 2-ethoxyethanol as alternatives to 2-butoxyethanol.

Ethylene glycol n-hexyl ether may also be used in the cleaning solution. Commercially available sources of ethylene glycol n-hexyl ether may be used (e.g. WINDEX MULTI-SURFACE SPARKLING ORANGE CLEANER, made by S.C. Johnson & Son, Inc.). It should also be clearly understood that substantial benefit may be derived from the use of alkyl ethers, ethylene glycol, ethylene glycol monomethyl ether as alternatives to ethylene glycol n-hexyl ether.

Citrus juice from a citrus fruit may also be used in the present cleaning solution. Lemon, for example, is known to be a natural cleaning agent and is also used to provide a pleasant aroma. Although lemon is used in the examples herein, it should be clearly understood that substantial benefit may also be derived from oranges, limes, and other citrus fruits containing a high level of citric acid.

Iodized salt may also be used in the present cleaning solution. Iodized salt is table salt mixed with a small amount of various salts of the element iodine. Although iodized salt is used in the examples herein, it should be clearly understood that substantial benefit may also be derived from kosher salt, sea salt, rock salt, or table salt. Iodized salt assists with a rapid abrasive action.

The present invention will be better understood from the examples below. These examples are illustrative only and not meant to unduly limit the scope of the invention. In the examples herein, percentages are provided to indicate a percentage of composition.

A cleaning solution in accordance with the present invention was prepared according to the formulation below.

Example 1

| Component | Amount | % by Weight |
|---|---|---|
| Carboxylic Acid | 2.00 oz | 12.50% |
| Dipropylene Glycol Monomethyl Ether | 4.50 oz | 28.13% |
| Iodized Salt | 0.50 oz | 3.12% |
| 91% Isopropyl Alcohol | 5.00 oz | 31.25% |
| 2-butoxyethanol | 1.00 oz | 6.25% |
| Ethylene Glycol N-Hexyl Ether | 0.30 oz | 1.88% |
| 100% Isopropanol | 0.20 oz | 1.25% |
| Water | 0.50 oz | 3.12% |
| 190 Proof Grain Alcohol | 1.00 oz | 6.25% |
| Raw Lemon Juice | 1.00 oz | 6.25% |
| TOTAL | 16.00 oz | 100% |

The cleaning solution was prepared by adding 2.00 oz of carboxylic acid, 4.50 oz of dipropylene glycol monomethyl ether, 0.50 oz (or 15 g) of iodized salt, 5.00 oz 91% isopropyl alcohol, 1.00 oz of 2-butoxyethanol, 0.30 oz of ethylene glycol n-hexyl ether, 0.20 oz of 100% isopropanol, 0.50 oz of water, 1.00 oz of 190 proof grain alcohol, and 1.00 oz of raw lemon juice. The cleaning solution was mixed with a stir bar until about 60-70% of the iodized salt was dissolved. When the ingredients are mixed together, the cleaning solution may begin to fizz. 1.00 oz. of the cleaning solution was then mixed (diluted) with an additional 1.00 oz of water. The diluted cleaning solution (i.e. the mixture of cleaning solution and additional water) was then heated in a microwave on HIGH for 40 seconds until it reached a maximum temperature of 180° F. During heating, the diluted cleaning solution may begin to expand and foam. After reaching the maximum temperature, the diluted cleaning solution was then sprayed onto a soiled surface (e.g. the residue on a glass smoker's pipe). The cleaning solution began to dissolve the pipe residue on contact. The residue was completely dissolved after approximately 30 seconds. The pipe glass pipe was then rinsed with water and was completely clean. Although the examples herein indicate that the cleaning solution is sprayed onto the cleaning surface, it should be clearly understood that the cleaning solution may be poured onto the soiled surface or applied to a cloth or sponge that is used to scrub the soiled surface.

Preferably, the cleaning solution of the present invention may be heated prior to use. The preferred temperature at which the cleaning solution is the most effective depends upon the material of the surface being cleaned as well as the amount of residue build-up on the surface. For example, the cleaning solution may be heated for 30 seconds on HIGH in a microwave when it is used to clean mild buildup, plastic, and delicate screens and surfaces. It may be heated for 60 seconds on HIGH when it is used to clean light, medium, and heavy build-up on all types of surfaces including hard plastic. For extra heavy build-up, cleaning metal, low-thermal-expansion borosilicate glass (like PYREX glassware), ceramic, or dissolving heavy glue, the cleaning solution may be heated on HIGH for 90 seconds. In order to prevent complete evaporation of the cleaning solution during heating, at least 2 oz of the cleaning solution may be used. The cleaning solution may also be heated for up to 120 seconds on HIGH when cleaning metal, low-thermal-expansion borosilicate glass (like PYREX glassware), or ceramic. In order to prevent complete evaporation of the cleaning solution during heating, at least 3 oz of the cleaning solution may be used. However, the cleaning solution is most effective, regardless of the material of the surface being cleaned, when it has a temperature of approximately 180° F. It should be clearly understood that the cleaning solution may still be effective if the cleaning solution is heated to an alternative temperature. And although it is preferable to heat the cleaning solution, it should be clearly understood that substantial benefit may still be derived without heating the cleaning solution at all; the solution is still effective without heating when it is used to treat mild build-up. However, if the cleaning solution is used without heating it, some light washing of the soiled surface (e.g. glass smoker's pipe) may be required after rinsing the cleaning solution off.

Several experiments were conducted with the solution of Example 1 wherein the ratio of the cleaning solution and water were varied. It should be clearly understood however, that substantial benefit may still be obtained wherein the cleaning solution is not diluted (mixed with additional water) prior to being applied to the soiled surface. The results are shown in the table below:

| Microwave time | 1 oz | 1 oz + 1 oz $H_2O$ | 2 oz | 2 oz + 1 oz $H_2O$ |
|---|---|---|---|---|
| 10 | 120 | 140 | 108 | 96 |
| 20 | 158 | 158 | 158 | 115 |
| 30 | 160 | 164 | 170 | 140 |
| 40 | 140 | 180 | 172 | 140 |
| 50 | 140 | 161 | 180 | 176 |
| 60 | 140 | 157 | 178 | 180 |
| 70 | 0 | 0 | 0 | 182 |
| 80 | 0 | 0 | 0 | 0 |
| 90 | 0 | 0 | 0 | 0 |

Where 1.00 oz of the cleaning solution was used alone without adding water, the cleaning solution reached a maximum temperature of 160° F. at 30 seconds of heating. Where 2.00 oz of the cleaning solution was used alone without adding water, the cleaning solution reached a maximum temperature of 180° F. after 50 seconds of heating. And where 2.00 oz of the cleaning solution was mixed with 1.00 oz of water, the diluted cleaning solution reached a maximum temperature of 182° F. after 70 seconds of heating. As the amount of the cleaning solution increased (irrespective of whether the cleaning solution was mixed/diluted with additional water), more time was required to heat the cleaning solution to its maximum temperature. Furthermore, the cleaning solution evaporates by about 20-25% every 60 seconds that it is heated. Therefore, it was observed that the mixture of 1.00 oz of the cleaning solution and 1.00 oz of water yields the preferred results because its maximum temperature of approximately 180° F. may be reached with a minimal amount of heating time (i.e. 40 seconds).

Another cleaning solution in accordance with the present invention was prepared according to the formulation below:

Example 2

| Component | Amount | % by Weight |
|---|---|---|
| Carboxylic Acid | 2.15 oz | 13.44% |
| Dipropylene Glycol Monomethyl Ether | 4.85 oz | 30.31% |
| Iodized Salt | 0.50 oz | 3.12% |
| 91% Isopropyl Alcohol | 4.50 oz | 28.13% |
| 2-butoxyethanol | 1.00 oz | 6.25% |
| Ethylene Glycol N-Hexyl Ether | 0.30 oz | 1.88% |
| 100% Isopropanol | 0.20 oz | 1.25% |
| Water | 0.50 oz | 3.12% |
| 190 Proof Grain Alcohol | 1.00 oz | 6.25% |
| Raw Lemon Juice | 1.00 oz | 6.25% |
| TOTAL | 16.00 oz | 100% |

The cleaning solution was prepared by adding 2.15 oz of carboxylic acid, 4.85 oz of dipropylene glycol monomethyl ether, 0.50 oz (or 15 g) of iodized salt, 4.50 oz 91% isopropyl alcohol, 1.00 oz of 2-butoxyethanol, 0.30 oz of ethylene glycol n-hexyl ether, 0.20 oz of 100% isopropanol, 0.50 oz of water, 1.00 oz of 190 proof grain alcohol, and 1.00 oz of raw lemon juice. The cleaning solution was mixed with a stir bar until about 60-70% of the iodized salt was dissolved. 1.00 oz. of the cleaning solution was then mixed (diluted) with an additional 1.00 oz of water. The diluted cleaning solution was then heated in a microwave on HIGH for 60 seconds until it reached a maximum temperature of 180° F. After reaching the maximum temperature, the diluted cleaning solution was then sprayed onto a soiled surface (e.g. the residue on a glass smoker's pipe). The cleaning solution began to dissolve the pipe residue on contact. The residue was completely dissolved after 30 seconds. The pipe glass pipe was then rinsed with water and was completely clean without any scrubbing required. It was observed that when the cleaning solution contains 7.00 oz or more of dipropylene glycol monomethyl ether and carboxylic acid combined, the cleaning process slows down because the cleaning solution does not heat high enough to break down the residue. A preferred about of dipropylene glycol monomethyl ether and carboxylic acid combined may be between 6 oz-7 oz. As the mixture starts to break down the pipe residue, the mixture becomes more viscous and sticky and therefore less effective in dissolving the residue.

Example 3

| Component | Amount | % by Weight |
|---|---|---|
| Carboxylic Acid | 0.0769 oz | .481% |
| Dipropylene Glycol Monomethyl Ether | 0.1731 oz | 1.082% |
| Iodized Salt | 1.00 oz | 6.25% |
| 91% Isopropyl Alcohol | 6.75 oz | 42.188% |
| 2-butoxyethanol | 2.00 oz | 12.50% |
| Ethylene Glycol N-Hexyl Ether | 0.60 oz | 3.75% |
| 100% Isopropanol | 0.40 oz | 2.50% |
| Water | 1.00 oz | 6.25% |
| 190 Proof Grain Alcohol | 2.00 oz | 12.50% |
| Raw Lemon Juice | 2.00 oz | 12.50% |
| TOTAL | 16.00 oz | 100% |

The cleaning solution was prepared by adding 0.0769 oz of carboxylic acid, 0.1731 oz of dipropylene glycol monomethyl ether, 1.00 oz of iodized salt, 6.75 oz 91% isopropyl alcohol, 2.00 oz of 2-butoxyethanol, 0.60 oz of ethylene glycol n-hexyl ether, 0.40 oz of 100% isopropanol, 1.00 oz of water, 2.00 oz of 190 proof grain alcohol, and 2.00 oz of raw lemon juice. The cleaning solution was mixed with a stir bar until about 60-70% of the iodized salt was dissolved. 1.00 oz. of the cleaning solution was then mixed (diluted) with an additional 1.00 oz of water. The diluted cleaning solution was then heated in a microwave on HIGH for 60 seconds until it reached a maximum temperature of 170° F. After reaching the maximum temperature, the diluted cleaning solution was then sprayed onto a soiled surface (e.g. the residue on a glass smoker's pipe). This composition produced a strong smell of alcohol. The cleaning solution appeared to breakdown light residue, but was less effective on heavier build-up. The cleaning solution also left spots on the areas of the glass pipe that were cleaned.

Example 4

| Component | Amount | % by Weight |
|---|---|---|
| Carboxylic Acid | 4.46 oz | 27.88% |
| Dipropylene Glycol Monomethyl Ether | 10.03 oz | 62.71% |
| Iodized Salt | 0.25 oz | 1.56% |
| 91% Isopropyl Alcohol | 0.25 oz | 1.56% |
| 2-butoxyethanol | 0.25 oz | 1.56% |
| Ethylene Glycol N-Hexyl Ether | 0.08 oz | 0.50% |
| 100% Isopropanol | 0.05 oz | 0.31% |
| Water | 0.13 oz | 0.81% |
| 190 Proof Grain Alcohol | 0.25 oz | 1.56% |
| Raw Lemon Juice | 0.25 oz | 1.56% |
| TOTAL | 16.00 oz | 100% |

The cleaning solution was prepared by adding 4.46 oz of carboxylic acid, 10.03 oz of dipropylene glycol monomethyl ether, 0.25 oz of iodized salt, 0.25 oz 91% isopropyl alcohol, 0.25 oz of 2-butoxyethanol, 0.08 oz of ethylene glycol n-hexyl ether, 0.05 oz of 100% isopropanol, 0.13 oz of water, 0.25 oz of 190 proof grain alcohol, and 0.25 oz of raw lemon juice. The cleaning solution was mixed with a stir bar until about 60-70% of the iodized salt was dissolved. 1.00 oz. of the cleaning solution was then mixed (diluted) with an additional 1.00 oz of water. The diluted cleaning solution was then heated in a microwave on HIGH for 60 seconds until it reached a maximum temperature of 186° F. This produced a large amount of foam that overflowed from its container during the heating process. After reaching the maximum temperature, the diluted cleaning solution was then sprayed onto a soiled surface (e.g. the residue on a glass smoker's pipe). The cleaning solution appeared to break down light residue, but was less effective on heavier build-up. The cleaning solution also left a film on the areas of the glass pipe that were cleaned. It was observed that a greater amount of 91% isopropyl alcohol was needed to dissolve the pipe residue and to prevent any spots or film from remaining on the glass pipe as the residue dissolved.

The foregoing description is provided to enable any person skilled in the relevant art to practice the various embodiments described herein. Various modifications to these embodiments will be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public.

What is claimed is:

1. A cleaning solution comprising:
carboxylic acid;
dipropylene glycol monomethyl ether;
iodized salt;
2-butoxyethanol;
ethylene glycol n-hexyl ether;
isopropanol;
water; and
grain alcohol, wherein the grain alcohol is between 100-190 proof.

2. The cleaning solution of claim 1, wherein the cleaning solution comprises:
between approximately 0.1 oz and approximately 4.5 oz of carboxylic acid;
between approximately 0.2 oz and approximately 10 oz of dipropylene glycol monomethyl ether;
between approximately 0.3 oz and approximately 1 oz of iodized salt;
between approximately 0.3 oz and approximately 2 oz of 2-butoxyethanol;
between approximately 0.1 oz and approximately 0.6 oz of ethylene glycol n-hexyl ether;
between approximately 0.4 oz and approximately 7.2 oz of isopropanol;
between approximately 0.1 oz and approximately 1 oz of water; and
between approximately 0.3 oz and approximately 2 oz of grain alcohol.

3. The cleaning solution of claim 1 further comprising citrus juice.

4. The cleaning solution of claim 3 wherein the cleaning solution comprises between approximately 0.3 oz and approximately 2 oz of citrus juice.

5. The cleaning solution of claim 1 wherein the cleaning solution comprises:
between approximately 0.5% by weight and approximately 27.9% by weight of carboxylic acid;
between approximately 1.1% by weight and approximately 62.7% by weight of dipropylene glycol monomethyl ether;
between approximately 3.1% by weight and approximately 6.3% by weight of iodized salt;
between approximately 1.6% by weight and approximately 12.5% by weight of 2-butoxyethanol;
between approximately 0.5% by weight and approximately 3.75% by weight of ethylene glycol n-hexyl ether;
between approximately 1.9% by weight and approximately 44.7% by weight of isopropanol;
between approximately 0.8% by weight and approximately 6.3% by weight of water; and
between approximately 1.6% by weight and approximately 12.5% by weight of grain alcohol.

6. The cleaning solution of claim 5 wherein the cleaning solution further comprises between approximately 1.6% by weight and approximately 12.5% by weight of citrus juice.

7. A cleaning solution comprising:

between 12.50% by weight and 13.44% by weight of carboxylic acid;

between 28.13% by weight and 30.31% by weight of dipropylene glycol monomethyl ether;

3.12% by weight of iodized salt;

between 28.13% by weight and 33.75% by weight of isopropanol;

6.25% by weight of 2-butoxyethanol;

1.88% by weight of ethylene glycol n-hexyl ether;

3.12% by weight of water; and 6.25% by weight of 190 proof grain alcohol.

8. The cleaning solution of claim 7 further comprising 6.25% by weight of raw lemon juice.

9. A method for cleaning a soiled surface comprising the steps of:

mixing a cleaning solution comprising:

between 0.48% by weight and 27.88% by weight of carboxylic acid;

between 1.08% by weight and 62.71% by weight of dipropylene glycol monomethyl ether;

between 3.12% by weight and 6.25% by weight of iodized salt;

between 1.87% by weight and 44.69% by weight of isopropanol;

between 1.56% by weight and 12.50% by weight of 2-butoxyethanol;

between 0.50% by weight and 3.75% by weight of ethylene glycol n-hexyl ether;

isopropanol;

between 0.81% by weight and 6.25% by weight of water; and between 1.56% by weight and 12.50% by weight of grain alcohol, wherein the grain alcohol is between 100-190 proof;

diluting the cleaning solution by adding 1 oz of water to every 1 oz of cleaning solution;

heating the diluted cleaning solution; and applying the diluted cleaning solution to the soiled surface.

10. The method of claim 9 further comprising the step of heating the diluted cleaning solution to approximately 180° F.

11. The method of claim 9 wherein the cleaning solution further comprises between 1.56% by weight and 12.50% by weight of raw lemon juice.

* * * * *